United States Patent [19]

Boyadjieff

[11] 4,348,920

[45] Sep. 14, 1982

[54] WELL PIPE CONNECTING AND DISCONNECTING APPARATUS

[75] Inventor: George I. Boyadjieff, Anaheim, Calif.

[73] Assignee: Varco International, Inc., Orange, Calif.

[21] Appl. No.: 174,154

[22] Filed: Jul. 31, 1980

[51] Int. Cl.[3] ..... B25B 17/00

[52] U.S. Cl. ..... 81/57.25; 81/57.16

[58] Field of Search ..... 81/57.16, 57.24, 57.25, 81/57.34, 57.35, 57.4, 57.41; 175/85; 166/77.5; 173/164

[56] References Cited

U.S. PATENT DOCUMENTS

| | | | |
|---|---|---|---|
| 2,000,221 | 5/1935 | Dawson | 81/57.25 |
| 2,792,198 | 5/1957 | Braun | 175/85 |
| 2,838,282 | 6/1958 | Colquitt | 175/85 |
| 2,898,792 | 8/1959 | Fox et al. | 81/57.41 |
| 3,629,927 | 12/1971 | Palmer | 81/57.34 |
| 3,760,658 | 9/1973 | Guier | 81/57.34 |
| 3,902,385 | 9/1975 | Haby | 81/57.34 |
| 3,921,473 | 11/1975 | Boyadjieff et al. | 81/57.34 |
| 3,961,319 | 6/1976 | Boyadjieff | 24/263 DG |
| 4,023,449 | 5/1977 | Boyadjieff | 81/57.34 |
| 4,049,065 | 9/1977 | Walter | 173/164 |
| 4,246,809 | 1/1981 | Keast et al. | 81/57.16 |

OTHER PUBLICATIONS

*Varco's Iron Roughneck,* Varco Oil Tools, 4/80, pp. 1–4.

*Primary Examiner*—James L. Jones, Jr.
*Attorney, Agent, or Firm*—William P. Green

[57] ABSTRACT

A power driven tool for making and breaking threaded connections in a well pipe is movable between a central position of alignment with the well axis, a second position offset from the well axis and above a mousehole, and a third retracted or inactive position offset at a side of the well axis opposite that at which the mousehole is located. The tool preferably includes a carriage which rolls along the rig floor between its different positions, desirably on spaced tracks located at opposite sides of the main axis of the well and the mousehole, with the pipe contacting mechanism being mounted for upward and downward movement relative to the carriage and for pivotal movement to an inclined position for alignment with an inclined mousehole, and preferably including an upper well pipe spinner and a lower torque wrench assembly.

15 Claims, 11 Drawing Figures

FIG. 7
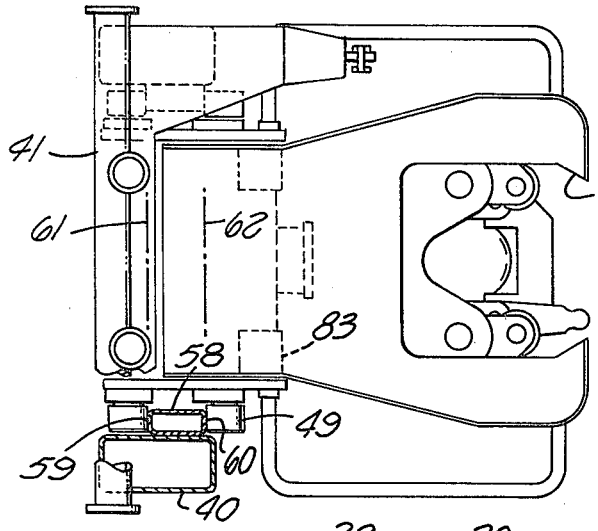
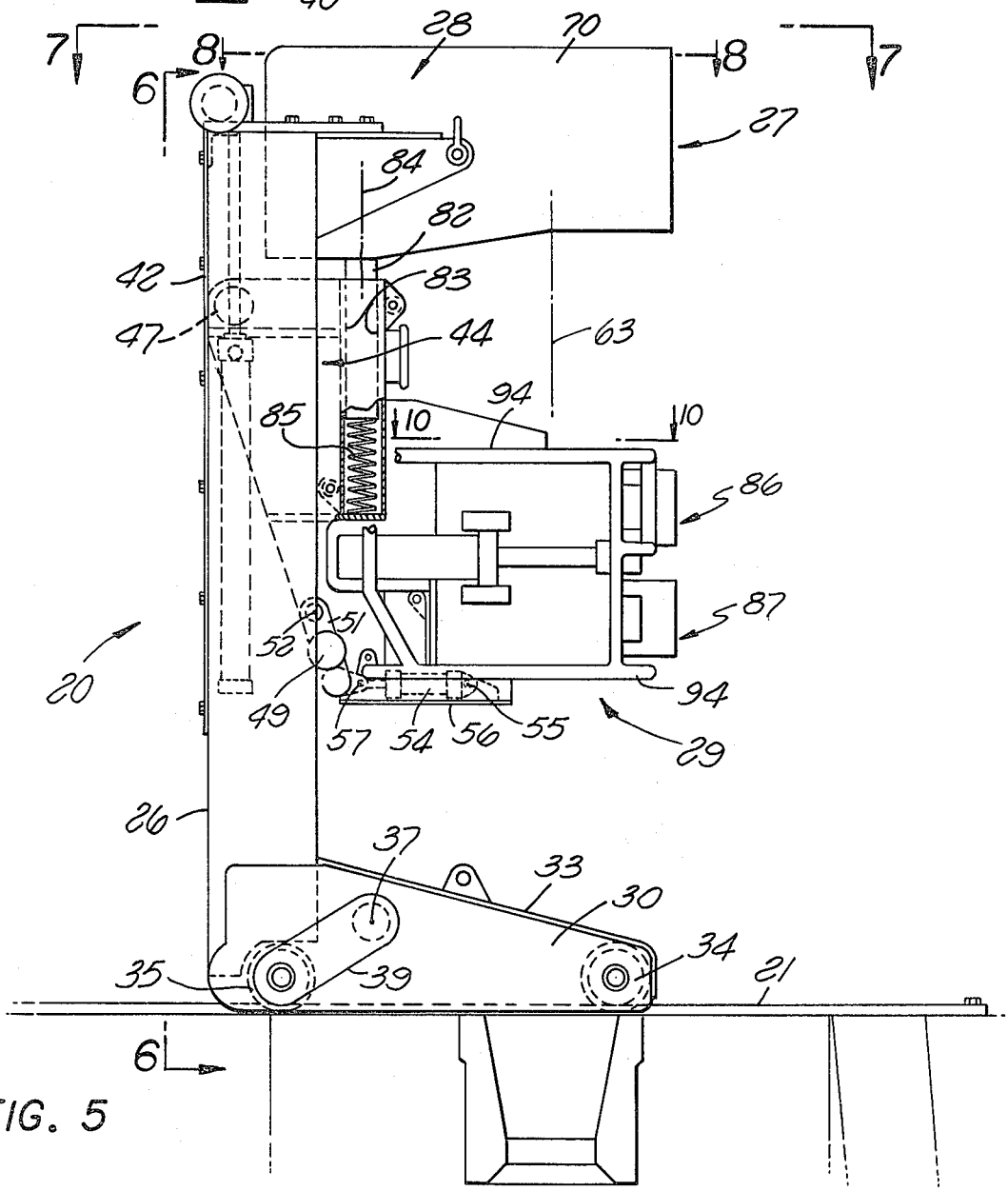
FIG. 5

WELL PIPE CONNECTING AND DISCONNECTING APPARATUS

BACKGROUND OF THE INVENTION

This invention relates to improved apparatus for connecting and disconnecting threaded joints in a string of well pipe.

In order to facilitate the making and breaking of threaded connections in a well drilling pipe string, a power operated tool is sometimes employed, being mounted to a support structure at a side of the drill pipe and having means adapted to project into engagement with the pipe to relatively rotate two sections thereof in order to screw them together or apart. Tools of this type may include a spinner device for rotating an upper section relatively rapidly into or out of connection with a lower pipe section, and may also include a torque wrench assembly operable to exert a greater torque on the pipe sections to either complete the final connecting action or initiate unscrewing rotation of the sections.

One disadvantage of previously devised tools of this type has been that in some installations the presence of the tool on the rig at a side of the drill pipe has tended to interfere with performance of other operations on the rig, and thus introduce inefficiency into the overall drilling process.

SUMMARY OF THE INVENTION

The present invention provides an improved tool of the above discussed general type mounted in a unique manner enabling it to efficiently and effectively perform the desired joint making and joint breaking operations when desired, and in addition mounting the tool for bodily withdrawal to a retracted position in which it does not interfere with or block performance of any other operation relative to the well pipe and its supporting or driving elements. A device embodying the invention is easily and quickly convertible from a condition for making and breaking joints in the main pipe string to a condition for connecting to or disconnecting from a pipe section in a mousehole at a side of the well. The tool of the invention is movable bodily between a central position in which the pipe driving parts are in alignment with the main axis of the well, and two additional positions offset from the main axis in essentially opposite directions. At one of these additional positions, the pipe contacting and driving elements are positioned to engage and act on a pipe section in the mousehole, while in the second additional position, offset to a side of the well opposite that at which the mousehole is located, the pipe contacting and turning elements are retracted to a location in which they will not obstruct or interfere with other operations. To enable such shifting movement of the tool between its specified conditions, the device includes a carriage which is adapted to roll on the surface of the rig floor along a predetermined path, and is preferably guided for such movement by engagement of wheels on the carriage with track means formed on the rig floor. These track means desirably include two spaced essentially parallel tracks received at opposite sides of the well axis and the rotary table of the rig.

The pipe contacting parts, preferably including a spinner and torque wrench as mentioned, are mounted for upward and downward movement relative to the carriage, for proper engagement with the pipe sections, and preferably are also mounted for tilting movement between a position in which their axis extends directly vertically for engagement with a vertical well pipe, and a position in which the axis of the spinner and torque wrench is disposed at a slight angle to the true vertical to engage and act against a pipe in the inclined mousehole.

BRIEF DESCRIPTION OF THE DRAWINGS

The above and other features and objects of the invention will be better understood from the following detailed description of the typical embodiment illustrated in the accompanying drawings, in which:

FIG. 5 is an enlarged side view similar to FIG. 3, but showing the device in greater detail;

FIG. 7 is a top plan view taken on line 7—7 of FIG. 5;

DESCRIPTION OF THE PREFERRED EMBODIMENTS

Figure 1:
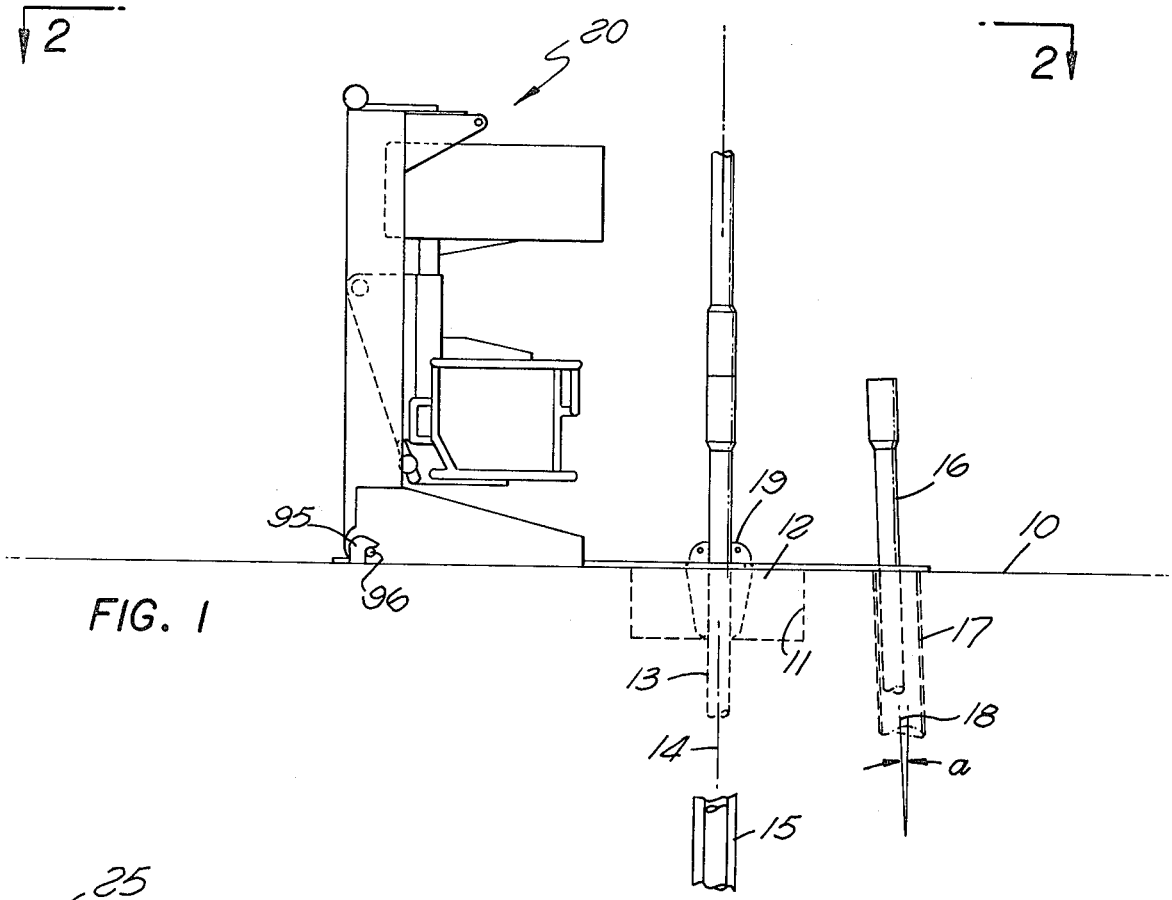
FIG. 1 is a somewhat diagrammatic side view of a well pipe connecting and disconnecting device embodying the invention.

The well drilling rig represented fragmentarily in FIG. 1 includes a rig floor 10 containing an opening 11 within which a rotary table 12 is mounted for rotating a drill string 13 about a vertical axis 14 to drill a well bore 15 in the earth. A section of pipe 16 which is to be added to the string 13, or which has been removed from the string, may be contained within the usual mousehole recess 17 which extends downwardly beneath the level of the rig floor at a location offset from the main axis 14 and the rotary table. This mousehole 17 may extend along an axis 18 which extends generally vertically but is disposed at a slight angle a with respect to the true vertical. When a pipe section is to be added to or removed from the string, the upper joint of the string 13 is supported in the rotary table by slips 19, as seen in FIG. 1.

Figure 2:
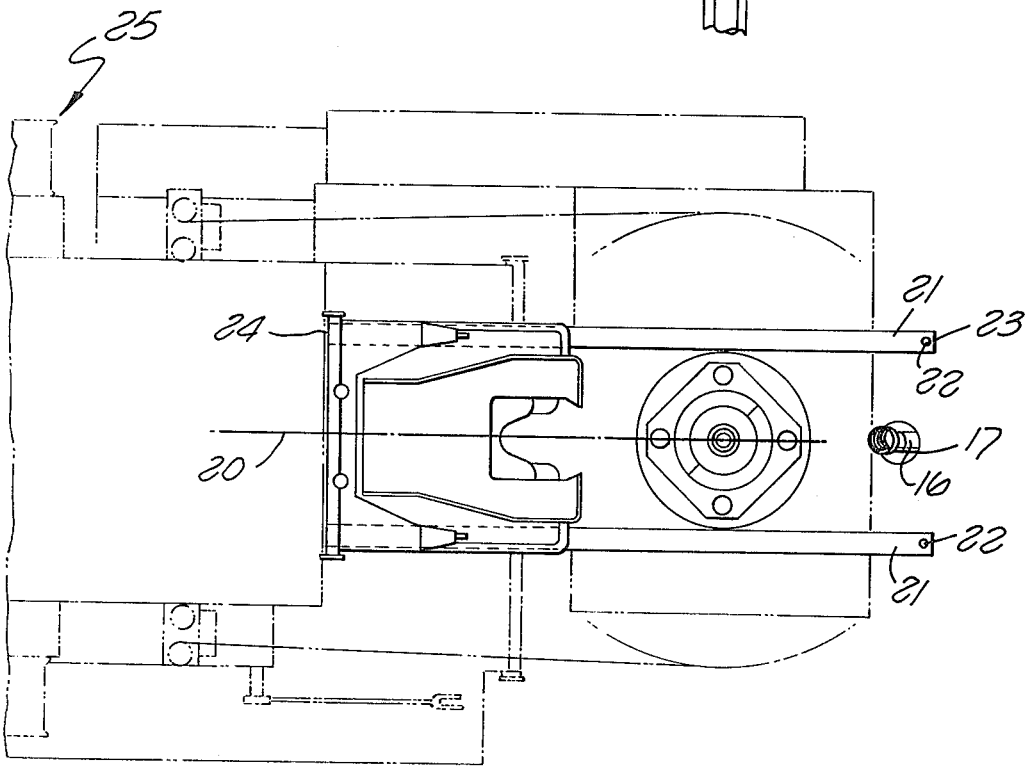
FIG. 2 is a plan view taken on line 2—2 of FIG. 1.
Figure 6:
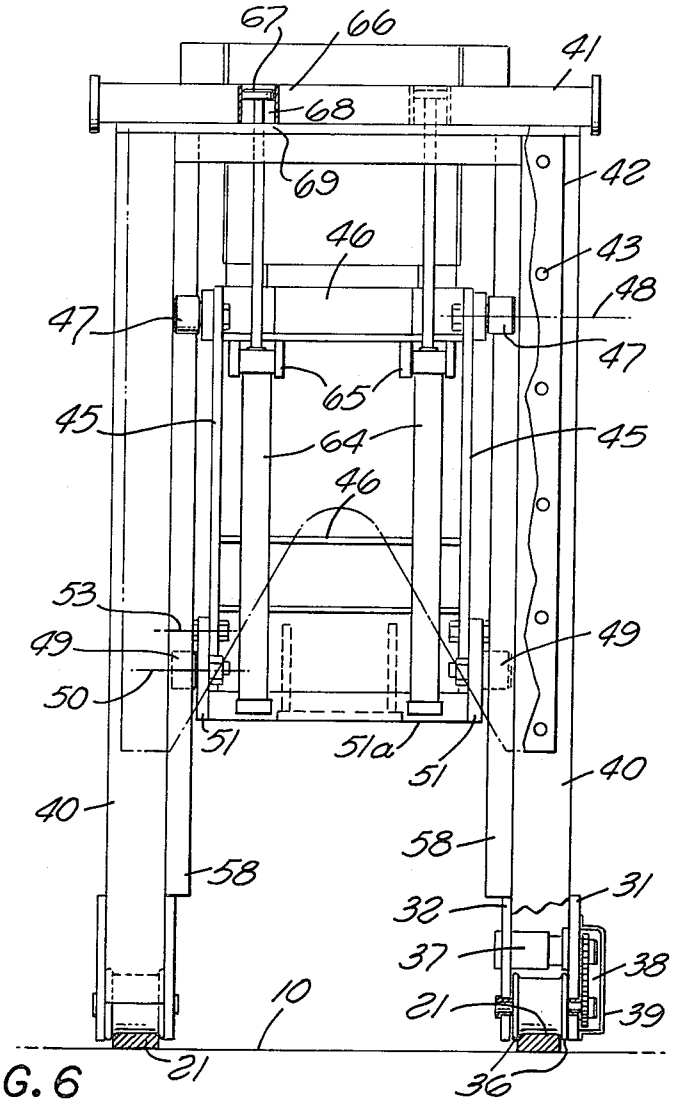
FIG. 6 is a rear elevational view taken on line 6—6 of FIG. 5.
Figure 4:
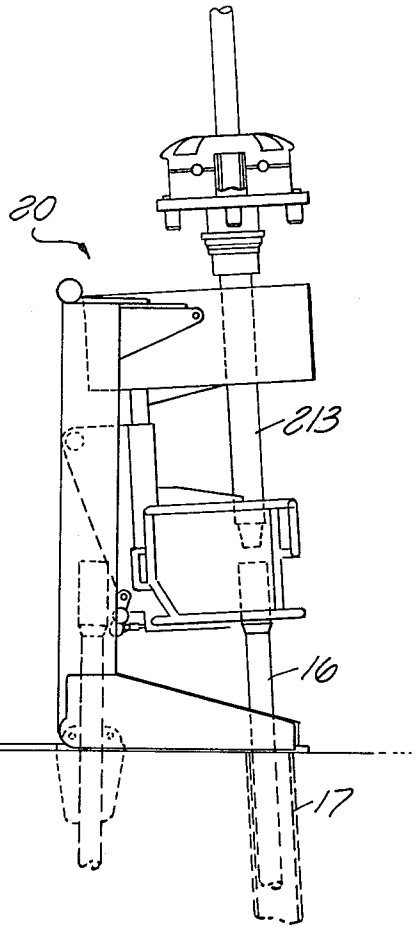
FIGS. 3 and 4 are views similar to FIG. 1, but showing the tool in its central position for making and breaking joints in the main drill string of a well installation (FIG. 3), and in its forward position for making and breaking connections with a pipe section in an inclined mousehole (FIG. 4)
Figure 3:
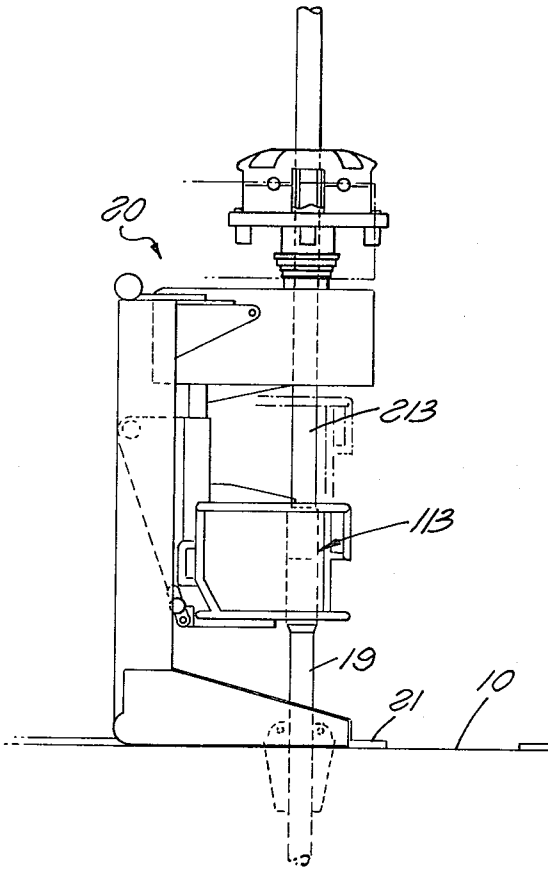

The pipe connecting and disconnecting tool 20 of the present invention is supported on the rig floor 10 and adapted to roll on the floor along an axis 20 extending diametrically of and intersecting axes 14 and 18 and between the central position of FIG. 3, the mousehole position of FIG. 4 and the retracted position of FIGS. 1 and 2. The tool is guided for movement between these positions by two parallel tracks 21 which may be strips of metal or other material having a typically rectangular cross section as seen in FIG. 6, and which may rest on the upper surface of the rig floor and be secured to it by bolts or other means 22. These tracks 21 extend parallel to the mentioned path 20 of movement of the tool 20, and are spaced equal distances to opposite sides of that path and axes 14 and 18. The right ends of the tracks as represented at 23 in FIGS. 1 and 2 project somewhat beyond the location of the upper end of mousehole 17, while the left ends 24 of the tracks as viewed in FIGS. 1 and 2 project a substantial distance to the left of the rotary table. In its retracted position of FIGS. 1 and 2, the tool 20 of the present invention is located between the drawworks 25 and the rotary table, to avoid interference with access to the well pipe from all directions except the side at which the drawworks are located.

Referring now to FIGS. 5, 6 and 7, the tool 20 includes a main carriage or frame structure 26 which moves along the tracks and which movably carries a joint making and breaking unit 27 including an upper spinner 28 and a lower torque wrench assembly 29. Carriage 26 is a rigid structure having two hollow horizontally elongated feet 30 received above the two tracks 21 respectively and each formed of two side walls 31 and 32 and an inclined top wall 33 extending between and bridging the space between walls 31 and 32. Within each of the feet 30, there are mounted two wheels 34 and 35 rotatable about parallel horizontal axes and adapted to engage a corresponding one of the tracks 21, with side flanges 36 of each of the wheels projecting downwardly at opposite sides of the coacting track to effectively retain the wheels on and guide them for rolling movement along the tracks. At least one of these wheels is power driven rotatively and in either direction by a motor 37 mounted in the corresponding foot of the carriage structure and driving the wheel through a chain and sprocket drive represented at 38 in FIG. 6. This chain and sprocket drive may be contained in and protected by a housing element 39 carried on the side of the foot 30 of the carriage.

In addition to lower portions 30, carriage 26 also includes two rigid typically hollow columns 40 projecting upwardly from the left ends of portions 30 as viewed in FIG. 5, with those columns preferably having the essentially rectangular horizontal section illustrated in FIG. 7 and being connected together at their upper ends by attachment to a horizontal top crosspiece 41 (FIGS. 6 and 7). A back cover or wall 42 may extend between columns 40 and be secured thereto by screws or other fasteners 43.

The spinner 28 and torque wrench 29 are carried by a structure 44 which is mounted for upward and downward and pivotal movement relative to carriage 26. This structure 44 may include two spaced parallel vertical side plates 45 (FIG. 6) which are rigidly secured together by members extending laterally therebetween as represented by the cross members 46, typically welded at their opposite ends to plates 45. At its upper end, structure 44 carries rotatably a pair of rollers 47 which turn about a common horizontal axis 48 relative to structure 44. This axis 48 of the upper rollers 47 is fixed relative to structure 44.

A second pair of rollers 49 is mounted rotatably to the lower end of structure 44, to turn about a common horizontal axis 50 which is parallel to axis 48. These lower rollers 49 and their axis 50 are shiftable generally horizontally relative to structure 44, between the positions of FIGS. 3 and 4. To attain such shifting, the lower rollers 49 are not mounted directly to structure 44, but rather are mounted rotatably to a pair of identical generally vertically elongated links 51, connected together with a bar 51*a*, whose upper ends are pivoted at 52 for swinging movement of the links about a common horizontal axis 53 between the FIG. 3 and FIG. 4 positions. The lower ends of the links are actuated leftwardly and rightwardly as seen in FIGS. 3, 4 and 5, by a fluid pressure actuated piston and cylinder mechanism 54, whose cylinder is pivoted at 55 to a portion 56 of structure 44, and whose piston is pivotally connected at 57 to bar 51*a* which is connected to the lower ends of the links 51, with rollers 49 being located vertically between the upper and lower ends of the links.

Rollers 47 and 49 engage a pair of guide members 58 which are rigidly carried at the inner sides of the two vertical columns 40 respectively. Guides 58 may be of an externally rectangular horizontal cross-section illustrated in FIG. 7, with that cross-section being uniform along the entire vertical extent of each of the guides 58, and with longitudinal axes of those guides extending parallel to one another and directly vertically. As seen in FIG. 7, the upper rollers 47 of structure 44 engage and roll upwardly and downwardly along the rear vertical planar surfaces 59 of guides 58, while lower rollers 49 engage and roll upwardly and downwardly along the forward planar parallel surfaces 60 of the guides. Surfaces 59 of the two guides are aligned with one another within a common vertical plane 61, while surfaces 60 are aligned with one another and lie in a common vertical plane 62 parallel to plane 61. When links 51 are in their position of FIG. 5, the rollers 47 and 49 effectively guide structure 44 for directly vertical upward and downward movement along the guides with the axis 63 of the spinner and torque extending directly vertically. When the piston and cylinder mechanism 54 actuates links 51 to their position of FIG. 4, the rollers mount structure 44 for directly vertical movement but with the axis 63 of the spinner and torque wrench inclined as seen in FIG. 4.

This upward and downward movement of structure 44 and the carried parts is attained by two similar hydraulic piston and cylinder units 64 (FIG. 6), whose cylinders are pivotally connected at 65 to structure 44, and whose piston rods are connected at 66 to the upper portion 41 of carriage or frame 26. More particularly, the upper ends of the piston rods may rigidly carry enlargements or heads 67, which are engageable downwardly against rubber cushioning rings 68 bearing against a horizontal plate 69 of carriage 26 to form an effective but cushioned connection between the piston rods and carriage 26. The piston and cylinder mechanisms 64 are power actuable in either direction to force structure 44 and its carried parts either upwardly or downwardly relative to the carriage as may be desired.

Figure 8:
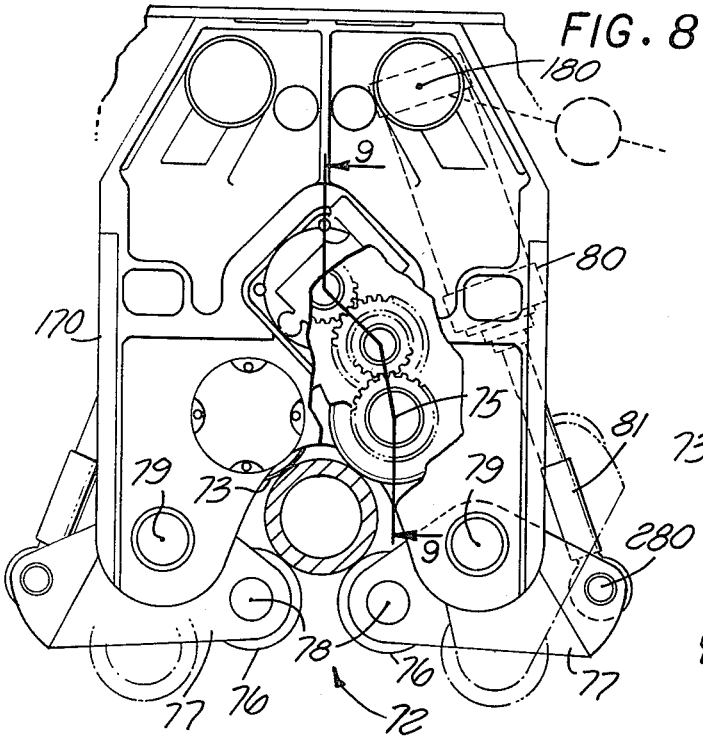
FIG. 8 is an enlarged fragmentary horizontal section taken primarily on line 8—8 of FIG. 5.
Figure 9:
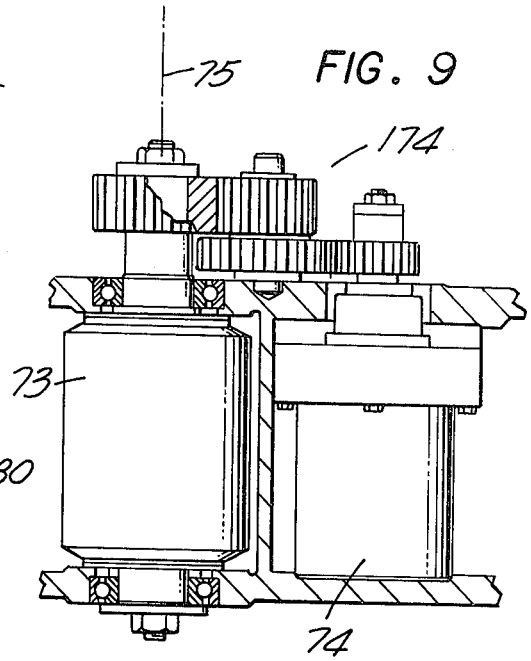
FIG. 9 is an enlarged fragmentary vertical section taken on line 9—9 of FIG. 8.

The spinner unit 28 includes a hollow housing 70 which may be shaped as illustrated in FIGS. 5 and 7 to provide a recess 71 within which a pipe section may be received for powered rotation by the spinner. As brought out in FIG. 8, the spinner mechanism 72 within housing 70 includes a frame or body 170 carrying two rollers 73 which are power driven by a motor 74 through gear trains 174 about parallel vertical axes 75, and two additional or outer rollers 76 mounted by swinging arms 77 to rotate about parallel vertical axes 78 relative to the swinging arms. These arms 77 are mounted to swing toward and away from one another about parallel vertical axes 79 between open positions in which a well pipe section can move laterally into engagement with rollers 73 (broken lines in FiG. 8) and closed positions in which all four of the rollers contact the pipe to hold it tightly in engagement with the power driven rollers 73 and spin the pipe about its axis. The arms 77 and carried rollers 76 are power actuable between their open and closed positions by two piston and cylinder mechanisms 80 having their cylinders connected pivotally to frame 170 at 180 and their pistons connected pivotally to arms 77 at 280. Motor 74 can be energized to rotate in either direction, and drive rollers 73 in either direction, to thereby rotate the contacted pipe section to either connect it to or disconnect it from the string.

Housing 70 of the spinner and its contained parts are mounted for bodily upward and downward movement relative to structure 44 by provision of two downwardly projecting guide tubes or rods 82 appropriately rigidly secured to housing 70 and received within two vertical parallel tubes 83 carried rigidly by structure 44. The telescopically interfitting tubes 82 and 83 may be close fits to guide the spinner 28 for movement along only an axis 84 (parallel to axis 63) relative to structure 44, with downward movement of housing 70 being resisted by coil springs 85 contained within tubes 83 and bearing upwardly against closed lower ends of tubes 82. Springs 85 may be of a strength to essentially counterbalance or support the weight of the spinner. The tubes 82 and 83 may be of square cross-section as indicated in FIG. 7.

Figure 10:
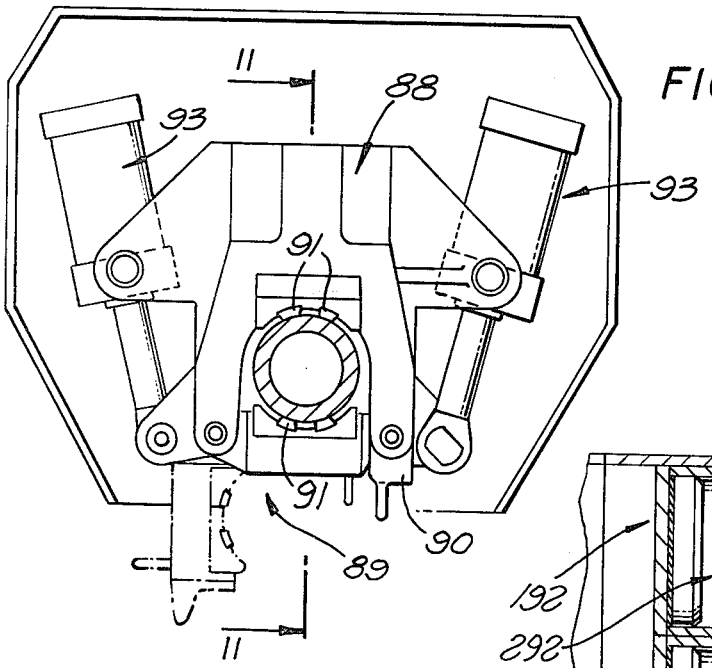
FIG. 10 is an enlarged fragmentary horizontal section taken on line 10—10 of FIG. 5.
Figure 11:
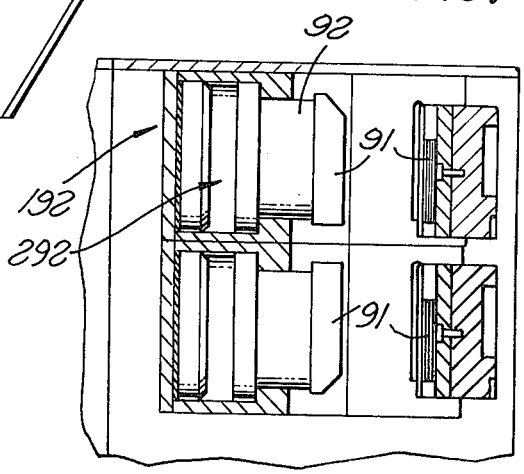
FIG. 11 is an enlarged fragmentary vertical section taken on line 11—11 of FIG. 10.

The torque wrench 29 includes an upper gripping assembly 86 adapted to grip and apply torque in either direction to an upper one of two pipe sections, and a lower gripping assembly 87 adapted to engage and apply torque in either direction to a lower one of two pipe sections. FIG. 10 illustrates generally the structure of the upper pipe gripping and turning section 86 of the torque wrench, which is shown as including a body 88 extending partially about the well pipe and a gate element 89 pivoted to body 88 for movement between an open position passing the pipe into engagement with the torque wrench and a closed position to grip the pipe. Gate 89 may be held in closed position by a latch element represented at 90. Gripping elements 91 carried by the gate and by a diametrically opposed piston 92 of a piston and cylinder mechanism 192 act to tightly grip the pipe when pressure fluid is forced into cylinder chamber 292 to actuate the piston rightwardly as viewed in FIG. 11. When gripping elements 91 of upper assembly 86 are thus actuated tightly against the pipe, assembly 86 can apply torque to the pipe in either a right hand or left hand direction.

The second and lower pipe gripping assembly 87 may be constructed essentially the same as the specifically described upper assembly 86. After these two assemblies have been actuated to tightly grip their corresponding pipe sections at the location of a threaded connection, the assemblies 86 and 87 are rotated relative to one another in opposite directions about axis 63 to either break the threaded connection or make it up to a tightened condition. This relative rotation is produced by two piston and cylinder mechanisms 93, each of which has its cylinder connected to one of the assemblies. Rails 94 may be attached to the structure 44 and project laterally beyond the torque wrench assembly to provide a handle structure and shield the parts.

A typical torque wrench and spinner which may be employed in the present apparatus are shown in U.S. Pat. No. 4,023,449 issued May 17, 1977.

During actual drilling of a well by rotation of pipe string 13 driven by rotary table 12, which is in turn driven by the motor of drawworks 25 in conventional manner, the tool 20 of the present invention is located in its retracted position of FIG. 1, withdrawn away from the axis of the rotating pipe and the rotary table and near or against the drawworks. Movement of the tool 20 in its retracting direction may be limited by a pair of hooks 95 projecting upwardly from the rig floor 10 adjacent tracks 21 and engageable with laterally projecting pins 96 on carriage 26. When the drilling reaches a point at which it becomes necessary to add another section of pipe to the upper end of string 13, the pipe string is suspended in the rotary table by slips 19 as seen in FIG. 1, with the threaded connection 113 between the kelly or kelly saver sub 213 and the remainder of the string being located just above the rotary table. With the string thus suspended, the tool 20 is moved along tracks 21, by energization of motor 37, to the FIG. 3 position in which axis 63 of the spinner and torque wrench is aligned with vertical axis 14 of the well and drill string. During this movement of the carriage and the remainder of the tool, the outer rollers 96 of the spinner and the gates of the torque wrench are open to enable reception of the well pipe within the spinner and torque wrench. Either prior to or after movement of the carriage to its FIG. 3 position, piston and cylinder mechanisms 64 are energized by pressurized hydraulic fluid to move structure 44 and the carried spinner and torque wrench vertically to a position such as that illustrated in FIG. 3 in which spinner 27 and the upper gripping assembly 86 of torque wrench 29 are both at a level to engage the upper of the two threaded sections at connection 113 just above the rotary table (the kelly or kelly saver sub), while the lower gripping assembly 87 of the torque wrench is at a level to engage the lower of these two joint ends. With the apparatus in this condition, the gates of the torque wrench are closed, the piston and cylinder mechanisms 192 of the two gripping assemblies 86 and 87 are actuated to grip the two connected pipe sections, and piston and cylinder mechanisms 93 are actuated to rotate assemblies 86 and 87 relative to one another to break the threaded connection 113. The upper gripping assembly 86 is then released by relieving the pressure from its piston and cylinder mechanism 192, and with the lower assembly 87 still in gripping condition spinner 27 is closed on the upper pipe (by cylinders 80) following which rollers 73 are driven by motor 74 to spin the upper pipe in an unscrewing direction and completely out of the lower pipe.

After the kelly has thus been completely detached from the section of pipe in the rotary table, structure 44 and the spinner and torque wrench are moved upwardly to the broken line position of FIG. 3, in which the torque wrench can clear the upper end of the pipe section 19 in the rotary table, and motor 37 is then energized to advance the carriage from the position of FIG. 3 to the position of FIG. 4, with the spinner acting to push the kelly rightwardly toward the FIG. 4 position of alignment with pipe section 16 in the mousehole. The piston and cylinder mechanism 54 is energized to tilt the spinner and torque wrench to the FIG. 4 condition, in the manner previously described, so that the axis 63 of the spinner and torque wrench are aligned with the axis of the mousehole, and so that as the spinner and torque wrench are then lowered by piston and cylinder mechanisms 64 the kelly sub will move into engagement with pipe section 16 for connection thereto. After the pipe sections have contacted one another, the spinner is energized to rotate the kelly and its sub into connected engagement with section 16, with lower assembly 87 of the torque wrench preventing rotation of section 16. The spinner is then released, and the upper torque wrench assembly 86 is actuated to grip the kelly sub. Relative rotation of the two torque wrench sections then rotates the upper section further to make up the threaded joint to a given torque. The spinner and torque wrench are next opened to allow the kelly and connected pipe section 16 to be lifted upwardly out of the mousehole and to a position above and in alignment with the drill string. Tool 10 is retracted to its FIG. 3 position for use in connecting the added pipe section 16 to the drill string. This connection is attained by first actuating lower gripping assembly 87 to grip the lower pipe section and causing the spinner to engage the added section 16 and spin it into connection with the string. Upper gripping assembly 86 of the torque wrench is then actuated to grip the upper pipe section and rotate it relative to lower gripping assembly 87 and the pipe section engaged thereby, to screw the two sections tightly together at a predetermined torque. After the connection is completed, the spinner and torque wrench can be retracted to the FIG. 1 position to enable continuation of the drilling operation.

When it is desired to remove an upper section of pipe from the drill string, a process essentially the reverse of that previously described can be followed, including disconnection of an upper joint of the string by first utilizing the torque wrench to break a threaded connection and then utilizing the spinner and the lower portion of the torque wrench to spin the upper section out. The tool when used to disconnect pipe (tripping out of the hole) is moved only between the FIG. 1 and FIG. 3 positions, and similarly when putting the pipe back into the hole, the same positions are used. The tool 20 can thus be utilized to either connect or disconnect two pipe sections at either the well axis location of FIG. 3 or the mousehole location of FIG. 4.

The freedom for vertical movement of spinner 28 relative to the torque wrench which is provided by the telescoping connection 82–83 between the spinner and torque wrench enables the spinner to move downwaredly or upwardly a short distance relative to the lower section 87 of the torque wrench during a spinning operation to compensate for the vertical movement of the upper pipe section as it is screwed into or unscrewed from a lower pipe section.

While a certain specific embodiment of the present invention has been disclosed as typical, the invention is of course not limited to this particular form, but rather is applicable broadly to all such variations as fall within the scope of the appended claims.

I claim:

1. A well tool comprising:

two parallel tracks adapted to extend along a rig floor at opposite sides of a rotary table opening;

a carriage having wheels engaging said tracks and movable therealong to guide the carriage for movement between a central position at the location of said rotary table opening, a mousehole position offset in one direction from said central position, and a retracted position offset in the opposite direction from said central position;

motor means for driving at least one of said wheels to move the carriage between said three positions thereof;

vertical guides carried by said carriage;

a mounting structure having rollers engaging said vertical guides and adapted to roll therealong to guide said structure for upward and downward movement relative to the carriage;

power means for moving said structure upwardly and downwardly relative to the carriage;

a torque wrench carried by said structure for upward and downward movement therewith and for movement along said tracks with the carriage and adapted to apply torque to make or break threadedly connected pipe sections at said central and mousehole positions of the carriage;

a spinner mounted to said structure above the torque wrench and for movement with the structure and upwardly and downwardly relative to it and the torque wrench; and power actuated means for moving at least one of said rollers carried by said structure relative to the structure in a direction pivoting the structure and carried torque wrench and spinner about the axis of another of said rollers carried by the structure and between a position in which an axis of the torque wrench and spinner is disposed directly vertically and a position in which said axis is disposed at a slight angle relative to the true vertical for engaging a pipe section at said mousehole location.

2. The combination comprising a well tool as recited in claim 1, a well drilling rig floor, a rotary table in said floor, a mousehole, and means mounting said tracks on said floor at opposite sides of the rotary table and mousehole at locations guiding said carriage and its carried parts for movement between said central position in which the axis of the torque wrench and spinner are aligned with the rotary table axis, said mousehole position in which said axis is aligned with the mousehole, and said retracted position in which said axis of the torque wrench and spinner is offset from the rotary table at a side opposite that at which the mousehole is located.

3. Apparatus for use in a well drilling rig within which a string of pipe is rotatable about an axis to drill a well and which has a mousehole offset from said axis, comprising:

a power driven unit operable to relatively rotate upper and lower threaded elements to connect or disconnect them;

means mounting said unit for guided movement in opposite directions from a central first position of alignment with said axis, for connecting or disconnecting joints in the string, to a second position of alignment with the mousehole for engagement with a pipe section therein, and to a retracted position at a side of the axis essentially opposite that at which the mousehole is located;

said mounting means including two parallel tracks extending along a floor of the rig at opposite sides of a rotary table opening, and a carriage mounting said unit and having wheels engaging said tracks and movable therealong to guide the carriage and unit for movement between said positions;

motor means for driving at least one of said wheels to move the carriage and unit between said three positions;

vertical guides carried by said carriage;

a mounting structure having rollers engaging said vertical guides and adapted to roll therealong to guide said structure for upward and downward movement relative to the carriage;

power means for moving said structure upwardly and downwardly relative to the carriage;

said unit including a torque wrench carried by said structure for upward and downward movement therewith and for movement along said tracks with the carriage and adapted to apply torque to make or break threadedly connected pipe sections at said central and mousehole positions of the carriage, and a spinner mounted to said structure above the torque wrench and for movement with the structure and upwardly and downwardly relative to it and the torque wrench; and power actuated means for moving at least one of said rollers relative to said structure in a direction pivoting the structure and carried torque wrench and spinner about the axis of another of said rollers carried by the structure and between a position in which an axis of the torque wrench and spinner is disposed directly vertically and a position in which said axis is disposed at a slight angle relative to the true vertical for engaging a pipe section at the location of said mousehole.

4. Well apparatus comprising:

a rig for drilling a well along a vertical axis and having a rig floor and an inclined mousehole offset in a first direction from said axis and operable to receive and hold a pipe section which is to be added to or has been removed from a string of pipe extending along said axis into the well;

a movable carriage;

a torque wrench mounted to said carriage for movement therewith and adapted to apply torque to make or break a joint between two pipe sections;

a spinner mounted to said carriage for movement therewith and adapted to spin one pipe section relative to another;

two spaced tracks extending along said rig floor;

said carriage having means engaging said tracks and movable therealong in a relation guiding the carriage for movement between a central position in which said torque wrench and spinner are aligned with said vertical well axis to connect and disconnect pipe at said axis, a mousehole position in which said torque wrench and spinner are offset in said first direction from the axis and aligned with said inclined mousehole, and a retracted third position in which said torque wrench and spinner are offset in the opposite direction from said vertical well axis; and means mounting said torque wrench and spinner for slight tilting movement relative to said carriage between a vertical condition for engaging and turning pipes disposed vertically at said central position and an inclined condition for engaging and turning pipes disposed at an angle to the true vertical in said mousehole position.

5. Well apparatus as recited in claim 4, including means mounting said torque wrench and spinner to said carriage for upward and downward movement relative thereto.

6. Well apparatus as recited in claim 5, including means mounting said spinner for upward and downward movement relative to said torque wrench.

7. Well apparatus as recited in claim 4, including power driven means for moving said carriage and said torque wrench and spinner between said three positions thereof.

8. Well apparatus as recited in claim 4, in which said rig includes a rotary table and said tracks extend along opposite sides of the rotary table.

9. Well apparatus as recited in claim 4, in which said first mentioned means include wheels on said carriage adapted to engage and roll along said tracks.

10. Well apparatus as recited in claim 4, in which said first mentioned means include wheels on said carriage adapted to engage and roll along said tracks, there being a motor for driving at least one of said wheels to move said carriage and said torque wrench and spinner between said positions thereof.

11. For use in a rig for drilling a well along a vertical axis and having a rig floor and an inclined mousehole offset in a first direction from said axis, apparatus comprising:

a movable carriage;

a torque wrench mounted to said carriage for movement therewith and adapted to apply torque to make or break a joint between two threadedly connected pipe sections;

a spinner mounted to said carriage for movement therewith and adapted to spin one pipe section relative to another;

two tracks adapted to extend along the rig floor in spaced relation;

said carriage having means adapted to engage said tracks and move therealong in a relation guiding the carriage for movement between a central position in which said torque wrench and spinner are aligned with said vertical well axis to connect and disconnect pipe at said axis, a mousehole position in which said torque wrnech and spinner are offset in said first direction from the axis and aligned with said inclined mousehole, and a retracted third position in which said torque wrench and spinner are offset in the opposite direction from said vertical well axis; and means mounting said torque wrench and spinner for slight tilting movement relative to said carriage between a vertical condition for engaging and turning pipes disposed vertically at said central position and an inclined condition for engaging and turning pipes disposed at an angle to the true vertical in said mousehole position.

12. Apparatus as recited in claim 11, including means mounting said torque wrench and spinner to said carriage for upward and downward movement relative thereto, and means mounting said spinner for upward and downward movement relative to said torque wrench.

13. Apparatus as recited in claim 11, in which said first mentioned means include wheels on the carriage engaging said tracks and movable therealong to guide the carriage for movement between said positions, said apparatus including motor means for driving at least one of said wheels to move the carriage and unit between said three positions, vertical guides carried by said carriage, a mounting structure having rollers engaging said vertical guides and adapted to roll therealong to guide said structure for upward and downward movement relative to the carriage, and power means for moving said structure upwardly and downwardly relative to the carriage.

14. For use in a rig for drilling a well along an axis and having a rig floor and a mousehole offset in a first direction from said axis, apparatus comprising:

a movable carriage;

a torque wrench mounted to said carriage for movement therewith and adapted to apply torque to make or break a joint between two threadedly connected pipe sections;

a spinner mounted to said carriage for movement therewith and adapted to spin one pipe section relative to another;

two tracks adapted to extend along the rig floor in spaced relation;

said carriage having means adapted to engage said tracks and move therealong in a relation guiding the carriage for movement between a central position in which said torque wrench and spinner are aligned with said axis to connect and disconnect pipe at said axis, a mousehole position in which said torque wrench and spinner are offset in said first direction from the axis and aligned with said mousehole, and a retracted position in which said torque wrench and spinner are offset in the opposite direction from said axis;

vertical guides carried by said carriage;

a mounting structure carrying said wrench and spinner and having rollers engaging said vertical guides and adapted to roll therealong to guide said structure for upward and downward movement relative to the carriage; and power actuated means for moving at least one of said rollers relativve to said structure in a direction pivoting the structure and carried torque wrench and spinner about the axis of another of said rollers carried by the structure and between a position in which an axis of the torque wrench and spinner is disposed directly vertically and a position in which said axis is disposed at a slight angle relative to the true vertical for engaging a pipe section at the location of said mousehole.

15. Well apparatus comprising:

a rig for drilling a well along an axis and having a mousehole at a location offset in a predetermined direction from said axis for holding a section of pipe which is to be added to or has been removed from a string of pipe extending along the axis;

a unit including a power driven spinner operable to relatively rotate upper and lower threaded pipe sections to connect or disconnect them and including a torque wrench for exerting a greater torque to make or break a joint;

means mounting said unit for movement in two essentially opposite directions from a central first position of alignment with said axis, for connecting or disconnecting two sections of said string, to a second position of alignment with said mousehole for engagement with a pipe section therein and to a retracted third position at a side of the axis essentially opposite that at which the mousehole is located;

said means including a carriage movable in said opposite directions from said central position;

vertical guides carried by said carriage;

a mounting structure carrying said wrench and spinner and having rollers engaging said vertical guides and adapted to roll therealong to guide said structure for upward and downward movement relative to the carriage; and power actuated means for moving at least one of said rollers relative to said structure in a direction pivoting the structure and carried torque wrench and spinner about the axis of another of said rollers carried by the structure and between a position in which an axis of the torque wrench and spinner is disposed directly vertically and a position in which said axis is disposed at a slight angle relative to the true vertical for engaging a pipe section at the location of said mousehole.

* * * * *